United States Patent [19]

Gazzola

[11] Patent Number: 4,862,520

[45] Date of Patent: Sep. 5, 1989

[54] OVERCOAT CONVERTIBLE INTO A BAG

[76] Inventor: Giovanni A. Gazzola, No. 187, Via Della Pineta Sacchetti, 00168 Rome, Italy

[21] Appl. No.: 190,676

[22] Filed: May 5, 1988

[30] Foreign Application Priority Data

May 7, 1987 [IT] Italy ..... 35792/87[U]

[51] Int. Cl.[4] ..... A41D 3/02

[52] U.S. Cl. ..... 2/85; 2/93; 2/69

[58] Field of Search ..... 2/85, 108, 93, 69

[56] References Cited

U.S. PATENT DOCUMENTS

| | | | |
|---|---|---|---|
| 2,058,474 | 10/1936 | Long | 2/88 |
| 2,146,243 | 2/1939 | Aug | 2/85 |
| 3,228,034 | 1/1966 | Grove . | |
| 4,055,853 | 11/1977 | Argento et al. | 2/93 |
| 4,225,978 | 10/1980 | Howerton | 2/88 |
| 4,307,470 | 12/1981 | Ezell | 2/85 |
| 4,475,251 | 10/1984 | Hopkins | 2/85 |
| 4,563,776 | 1/1986 | Boesen | 2/85 |
| 4,563,777 | 1/1981 | Park | 2/85 |

FOREIGN PATENT DOCUMENTS

| | | | |
|---|---|---|---|
| WO82/01119 | 4/1982 | World Int. Prop. O. | 2/85 |

*Primary Examiner*—Ronald Feldbaum

*Attorney, Agent, or Firm*—Wenderoth, Lind & Ponack

[57] ABSTRACT

An overcoat that can be converted into a bag includes a zip-fastener having one set of teeth arranged in correspondence to the shoulders of the overcoat and on the two side parts down to a mid-line of the overcoat itself, and the other set of teeth arranged in correspondence to the lower edge of the overcoat and on the two side parts, from the bottom towards top, to a mid-line of the overcoat, the zipper being so arranged as to realize, when it is closed, the containment of all fore parts of the overcoat. Fasteners are provided crosswise on the overcoat at a mid-line to delimit at least one pocket that may contain various items when the overcoat is transformed into a bag. A handle is arranged at a position close to said fasteners. Projecting parts on the end of the belt engage the belt loops to form a shoulder-belt.

7 Claims, 2 Drawing Sheets

OVERCOAT CONVERTIBLE INTO A BAG

BACKGROUND OF THE INVENTION

The present invention relates to an overcoat convertible into a bag, and more particularly it relates to an overcoat which, when it is not being worn, can be so folded and arranged as to realize a handy and comfortable bag that can be carried by hand or across the shoulders.

Very often one happens to carry an overcoat with no immediate need of putting it on. It is evident that in such conditions one feels uneasy in carrying the overcoat, being at a loss for keeping his hands free or for carrying other things, i.e. newspapers, documents and so on.

Moreover, it is well known that, nowadays, as a result of the ever increasing activity in life, there is need to realize solutions that make it easier and more practical to travel, to shift from a place to another one in general.

Accordingly, it is quite evident that it is advantageous to have the possibility of forming an overcoat so as to be completely foldable on itself, thus realizing a bag which is provided with at least one pocket for housing any type of item.

BRIEF SUMMARY OF THE INVENTION

Such a result is obtained, according to the present invention, by an overcoat which is provided with a zip-fastener including two parts arranged along the side edges and in correspondence, respectively, to the shoulders and to the lower edge of the overcoat. By folding the sleeves and the lower parts of the overcoat within the perimeter delimited by the zipper, and then folding the overcoat so folded about a mid-line until the teeth of the two parts of the zipper fit together to be fastened, a bag is formed. Upper pocket openings are provided in turn with additional zip-fasteners or the like.

Accordingly, it is a specific object of the present invention to provide an overcoat that can be converted into a bag. The overcoat comprises a zip-fastener whose two series of teeth are arranged, respectively, at the points corresponding to the shoulders of the overcoat and along the two side parts down to the mid-line at about half the length of the overcoat itself, and at the points corresponding to the lower edge of the overcoat and along the two side parts, from the bottom part towards the top, up to the mid-line at about half the length of the overcoat. The zipper is thus arranged to form, when it is closed, a container housing the fore components of the overcoat itself. At least one fastening means is provided crosswise on said overcoat, at about half the length of the same, to delimit a pocket that may contain various items when the overcoat is transformed into a bag. Handle means are arranged close to said fastening means.

According to a preferred embodiment of the overcoat of the present invention, the handle means are made up of a half-belt of the overcoat itself. A belt of the overcoat is provided a its ends with projecting parts which engage with belt loops of the overcoat, and with an adjustment buckle, between the loops, so that the belt can be employed as a shoulder-belt when the overcoat is carried and employed as a bag.

Again according to the present invention, two transverse pocket fastening means are provided, on the sides of the handle means, the fastening means consisting of two zip-fasteners or of hook-and-loop type fastening means.

BRIEF DESCRIPTION OF THE DRAWINGS

The present invention will be disclosed in the following with reference to a preferred embodiment shown in the enclose drawings, wherein.

DETAILED DESCRIPTION OF THE INVENTION

Figure 1:
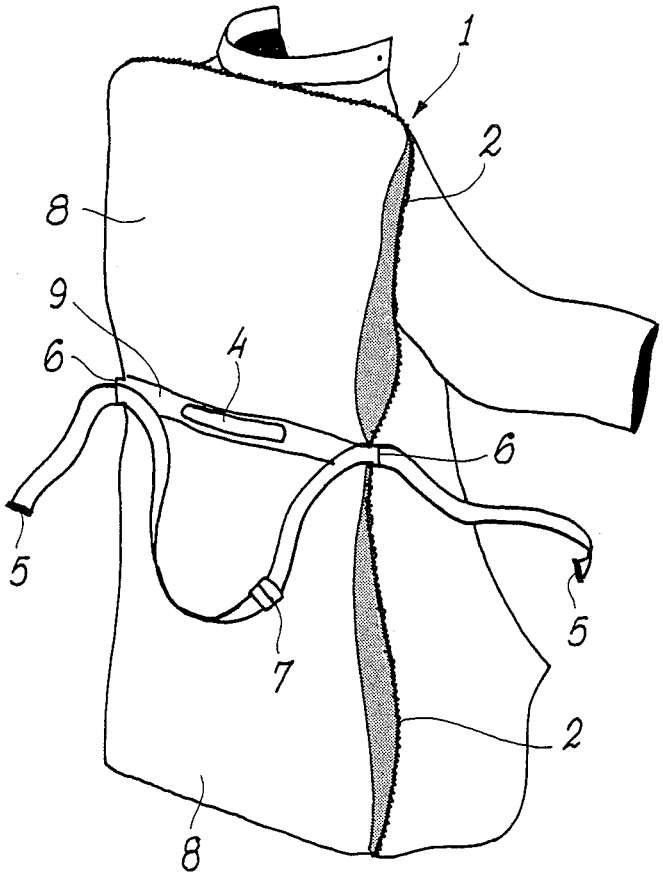
FIG.1 is a perspective back view of the overcoat according to the present invention.

With reference now more particularly to FIG. 1 of the drawings, an overcoat 1 according to the invention is provided with a zip-fastener 2 having mating teeth arranged along the two side parts and, respectively, at the points corresponding to the shoulders and to the lower edge of the overcoat 1.

In addition, a belt 3 and a half-belt 4 are provided, which members will be employed, once the overcoat 1 has been folded, as a shoulder-belt and as a handle, respectively.

The belt 3 is provided at its two ends with two projecting parts 5 which engage, when the same is employed as a shoulder-belt, with the loops 6.

At the back part with respect to the overcoat 1, the belt 3 is also provided, between the two loops 6, with an adjustment buckle 7.

In order to convert the overcoat 1 into a bag, it is sufficient to fold the sleeves and the fore parts of the overcoat 1 inward so that they become contained within the inner part of the back 8 of said overcoat.

Figure 2:
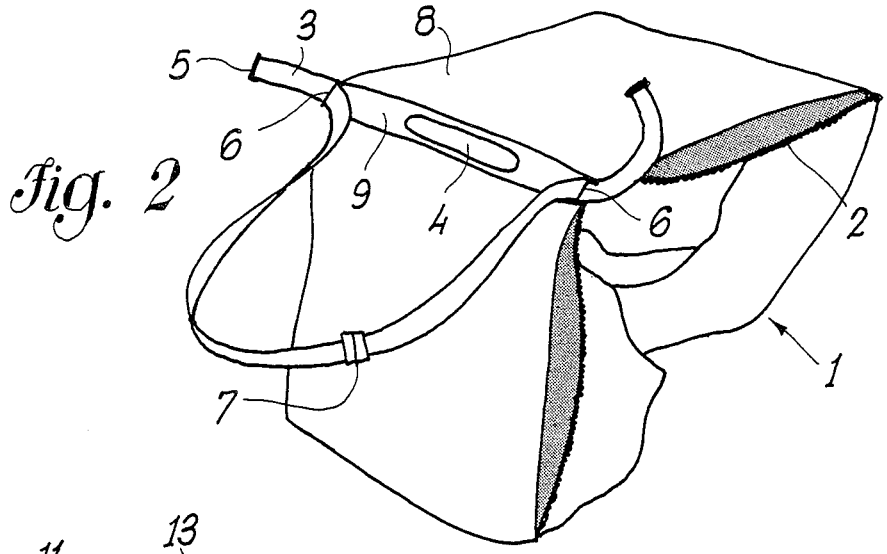
FIG. 2 is a perspective view of the overcoat according to the present invention during the folding operation of the same.

Then the back part 8 is folded about a mid-line (see FIG. 2) so that the fore parts of the overcoat 1 are contained inside, carrying the two parts of said zipper 2 into a position which allows them to be fastened.

Figure 3:
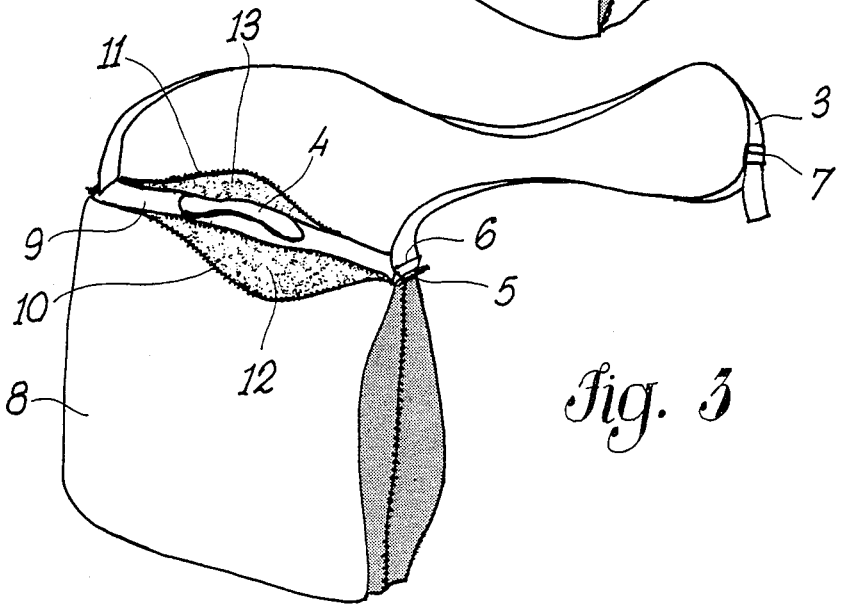
FIG. 3 is a perspective view of the overcoat according to the present invention, converted into a bag.

After fastening the zip-fastener 2, the overcoat 1 takes on the shape of a bag as shown in FIG. 3.

Crosswise in the central position and at the point corresponding to the stiffening part 9 (FIG. 1), the overcoat 1 is provided with two fasteners 10 and 11 that fasten the two pockets of the overcoat when converted into a bag, and that are shown in FIG. 3 by the reference numbers 12 and 13.

The half-belt 4 performs the function of a handle, while the belt 3 acts as the shoulder-belt of the bag.

Thus, a bag is obtained, having two pockets 12 and 13 which are very large and hence suitable for carrying various items the operations for obtaining the same being extremely simple, and consisting of folding the overcoat and fastening the containment zipper 2.

I claim:

1. A garment convertible into a bag, comprising;

a garment including at least fore and back portions, said back portion defining shoulder, bottom, side and mid-line areas, said mid-line area extending between said side areas at substantially the mid-point between said shoulder and bottom areas;

a zipper having mating teeth, one set of said teeth extending along said shoulder area and down said side areas to approximately said mid-line area and the other set of said teeth extending along said bottom area and up said side areas to approximately said mid-line area, such that when said garment is folded about said mid-line area and said zipper is fastened, all other portions of said garment may be contained within said back portion, thereby forming a bag;

loops on said garment proximate said side areas and substantially near said mid-line area; and a belt threaded through said loops, said belt having a projecting part at each end thereof, such that when said garment is converted into a bag said projecting parts will engage said loops and said belt will function as a shoulder-belt for said bag.

2. A garment according to claim 1, wherein said belt includes an adjustment buckle.

3. A garment according to claim 1, further comprising a half-belt located in said mid-line area, such that when said garment is converted into said bag said half-belt will function as a handle for said bag.

4. A garment according to claim 1, further comprising at least one pocket on said back portion, said at least one pocket having an opening proximate said mid-line area.

5. A garment according to claim 4, further comprising fastening means for said opening of said pocket.

6. A garment according to claim 5, wherein said fastening means comprises a zipper.

7. A garment according to claim 5, wherein said fastening means comprises a hook-and loop fastener.

* * * * *